US005829352A

United States Patent [19]

Taira et al.

[11] Patent Number: 5,829,352

[45] Date of Patent: Nov. 3, 1998

[54] STAMP DEVICE HAVING SEAL PLATE AND SUPPORT PORTION

[75] Inventors: Hiroshi Taira, Ichinomiya; Keiji Seo, Nagoya; Teruo Imamaki, Kasugai, all of Japan

[73] Assignee: Brother Kogyo Kabushiki Kaisha, Nagoya, Japan

[21] Appl. No.: 826,722

[22] Filed: Apr. 7, 1997

[30] Foreign Application Priority Data

May 14, 1996 [JP] Japan ..... 8-119088

[51] Int. Cl.[6] ..... B41K 1/50; B41K 1/56

[52] U.S. Cl. ..... 101/327; 101/381; 101/125; 101/127.1

[58] Field of Search ..... 101/333, 327, 101/381, 401.1, 405, 125, 127.1

[56] References Cited

U.S. PATENT DOCUMENTS

| | | | |
|---|---|---|---|
| 1,191,820 | 7/1916 | Pannier, Jr. | 101/381 |
| 1,608,541 | 11/1926 | Willard | 101/381 |
| 2,176,160 | 10/1939 | Uhl, Jr. | 101/381 |
| 2,899,895 | 8/1959 | Tannery | 101/381 |
| 2,966,116 | 12/1960 | Harris et al. | 101/327 |
| 3,282,209 | 11/1966 | Muskin | 101/405 |
| 3,855,925 | 12/1974 | Funahashi | 101/333 |
| 3,973,495 | 8/1976 | Rowe | 101/405 |
| 4,347,787 | 9/1982 | Takada et al. | 101/333 |
| 4,441,422 | 4/1984 | Dreeben | 101/125 |
| 5,048,415 | 9/1991 | Shih | 101/103 |
| 5,392,711 | 2/1995 | Kainuma | 101/401.1 |
| 5,577,444 | 11/1996 | Toyama | 101/327 |
| 5,611,279 | 3/1997 | Ando et al. | 101/333 |

FOREIGN PATENT DOCUMENTS

| | | |
|---|---|---|
| 0 644 059 A1 | 3/1995 | European Pat. Off. . |
| A-7-251558 | 10/1995 | Japan . |

OTHER PUBLICATIONS

Patent Abstracts of Japan, vol. 017, No. 368 (M–1443), Jul. 12, 1993, Publication No. 05058015, Pub. Date Sep. 3, 1993.

*Primary Examiner*—John S. Hilten
*Assistant Examiner*—Leslie Grohusky
*Attorney, Agent, or Firm*—Oliff & Berridge, PLC

[57] ABSTRACT

A stamp device for a seal plate is provided, which is configured so that the seal plate is easily attachable to and detachable from a supporter of the stamp device for removal or replacement and so that the seal plate does not detach or shift from the stamp device during a stamping or marking operation. The stamp device includes a supporter having a pair of longitudinally extending engaging claws for pinching opposite longitudinally extending edge faces of the seal plate; a recessed groove stopper portion for receiving and holding one end portion of the seal plate; and a pressure sensitive weak adhesive layer provided on a seal plate supporting face of the supporter.

19 Claims, 11 Drawing Sheets

STAMP DEVICE HAVING SEAL PLATE AND SUPPORT PORTION

BACKGROUND OF THE INVENTION

1. Field of the Invention

The invention relates to the structure of a stamp device for supporting and mounting a seal plate comprising a rectangular, foamed plastic, so as to have sponge-like characteristics, substrate formed of continuous foams, defined as foams having a substantially uniform foam structure throughout, and including a seal face portion. The seal face portion includes a first melted and solidified portion through which ink cannot permeate and a second portion (character forming portion), which has not been melted and solidified, through which ink can permeate by selectively heating the surface of the seal face portion by, for example, a thermal head.

2. Description of the Related Art

Conventionally, as disclosed in Japanese Unexamined Patent Publication No. 7-251558, published in October 1995, hereby incorporated by reference, seal plates of this kind are thin and flexible with a mirror image of a character (seal image) of, for example, a predetermined letter, or figure formed on a seal face portion thereof. In the case of a conventionally well-known rubber seal, a stamp device is used in which a back face (a face opposite to the seal face portion) of the seal plate is directly mounted onto a lower face of a flat base of the stamp device by an adhesive agent, or the seal plate is adhered onto the lower face of the base and an ink impregnated pad is contacted to the back face of the seal plate with a handle being mounted onto an upper face of the base.

However, once the seal plate is fixed onto the base by the adhesive agent, it is difficult to peel the seal plate off the base. Further, when the adhesive strength is high, the seal plate is damaged during the peel-off operation.

Further, as disclosed in the prior art, it is extremely easy to form the mirror image shape of a predetermined character on the seal plate. Therefore, various characters can be formed respectively on a plurality of seal plates and the various seal plates can be used on a single stamp device by simply interchanging them. However, fixing the seal plate on the base by an adhesive agent is not suitable for such a use.

Also, it is necessary to make the seal plate easily attachable and detachable to and from a supporter for adopting a method wherein a thermal head is moved onto a seal face portion of the seal plate and pressed thereon to form the mirror image of a character onto the strip-shaped seal plate.

SUMMARY OF THE INVENTION

An object of the invention is to overcome the above and other disadvantages and deficiencies of the prior art and to provide a stamp device wherein a seal plate is simply attachable to and detachable from a supporter.

In order to achieve the above-described object, according to an embodiment of the invention, there is provided a stamp device for a flat-shaped seal plate, on which can be formed a first melted and solidified portion through which ink cannot permeate and a second portion, which has not been melted and solidified, through which ink can permeate at a seal face portion, the seal plate being formed of a foamed plastic substrate having continuous foams, and a supporter for supporting a back face of the seal plate. The supporter is provided with a pair of engaging claws for pinching longitudinally extending opposite edge faces of the seal plate and a recessed groove stopper portion for receiving therein and holding a first end portion of the seal plate.

As stated above, the seal plate is structured to be attachable to and detachable from the supporter by the pair of engaging claws pinching the longitudinally extending opposite edge faces of the seal plate and the recessed groove stopper portion and therefore, the seal plate can be removed from the stamp device and interchanged with another seal plate easily. The seal plate when mounted on the stamp device does not come off the supporter even if the attitude of the stamp device is changed such that the seal plate faces downwardly. Further, because the seal plate is easily detachable, the stamp device can be used repeatedly by interchanging the seal plate.

Also, the supporter can be provided with a pivoting pinching device for pinching a second end portion of the seal plate opposite to the first end portion having the recessed groove stopper portion between the pivoting pinching device and a face of the supporter supporting the seal plate at the second end portion of the supporter. With such a structure, due to the increased area of the seal plate that is held, the possibility of shift or disengagement of the mounted seal plate from the stamp device is further reduced.

According to another embodiment of the invention, there is provided a stamp device for a flat-shaped seal plate, on which can be formed a first, melted and solidified portion through which ink cannot permeate and a second portion, which has not been melted and solidified, through which ink can permeate at a seal face portion, the seal plate being formed of a foamed plastic substrate having continuous foams, and a supporter for supporting a back face of the seal plate. The supporter is provided with a recessed groove stopper portion for receiving therein and holding a first end portion of the seal plate and a pivoting pinching device for pinching a second end portion of the seal plate between the pivoting pinching device and a face of the supporter supporting the seal plate.

As described above, the seal plate is structured to be attachable to and detachable from the supporter by the recessed groove stopper portion and the pivoting pinching device. Accordingly, the seal plate can be removed from the stamp device and interchanged with another seal plate easily.

Further, the seal plate when mounted on the stamp device does not come off of the supporter even if the attitude of the stamp device is changed such that the seal plate faces downwardly. Also, because the seal plate is easily detached from the supporter by pivoting the pivoting pinching device to release the pinched seal plate, the stamp device can be used repeatedly by exchanging the seal plate.

According to an additional embodiment of the invention, there is provided a stamp device for a flat-shaped seal plate, on which can be formed a first, melted and solidified portion through which ink cannot permeate and a second portion, which has not been melted and solidified, through which ink can permeate at a seal face portion, the seal plate being formed of a foamed plastic substrate having continuous foams, and a supporter for supporting a back face of the seal plate. The supporter is provided with a pair of pivoting pinching devices for pinching both end portions of the seal plate between the pair of pivoting pinching devices and a face of the supporter for supporting the seal plate.

With this structure, the seal plate can be made to be attachable to and detachable from the supporter only by the operation of the pair of pivoting pinching devices. Thus, the interchange of seal plates mounted to the stamping device is facilitated and disengagement or shift of the seal plate can be prevented due to the pinching of the seal plate.

BRIEF DESCRIPTION OF THE DRAWINGS

These and other aspects and advantages of the invention will become apparent from the following detailed description of preferred embodiments when taken in conjunction with the accompanying drawings, in which.

DETAILED DESCRIPTION OF THE PREFERRED EMBODIMENTS

Figure 1:
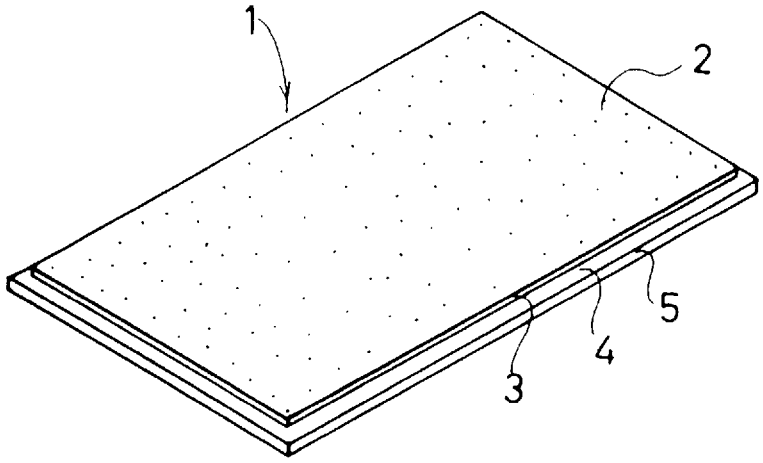
FIG. 1 is a perspective view of a seal plate according to the invention.

While the invention will hereinafter be described in connection with preferred embodiments thereof, it will be understood that it is not intended to limit the invention to those embodiments. On the contrary, it is intended to cover all alternatives, modifications and equivalents that may be included within the spirit and scope of the invention as defined by the appended claims.

For a general understanding of the features of the invention, reference is made to the drawings. In the drawings, like reference numerals have been used throughout to designate identical elements.

FIG. 1 is a perspective view of a seal plate 1. The seal plate 1 includes four side faces and top and bottom faces. The seal plate 1 is formed of a foamed plastic substrate having continuous foams that have been treated in an ink nonpermeable way. The base foamed plastic substrate is made of a hard or semihard polyolefin group resin having fine continuous foams. Alternately, a foamed plastic having fine continuous foams comprising a polyurethan group resin, vinyl chloride resin, ABS resin, ethylene-vinyl acetate copolymer, or other resins in place of the above-described material may be used. The foamed plastics may be sliced into a flat plate shape after removing a skin covering the outer face after foaming. Alternatively, a face thereof which is brought into contact with a mold for foaming may be used as the seal face side. The preferred thickness dimension of the seal plate 1 is about 1 mm through 3 mm.

As illustrated in FIG. 1, to create a seal face portion 2 from a predetermined portion of the top face of the seal plate 1, the remaining portions, that is, the melted and solidified portions 3, 4, the four surrounding side faces 5 of the seal plate 1, and the bottom face of the seal plate are pressed into a heated mold to be covered with an ink nonpermeable thin film layer formed where the foams are melted and solidified. When the back face (bottom face in FIG. 1) of the seal plate 1 is maintained as an ink permeable portion, that is, which has not been melted and solidified, ink can be supplied for a long period of time in a continuous stamping operation by contacting an ink impregnating pad to the back face of the seal plate 1. Also, the seal plate 1 can be made without the rigid backplate.

Figure 2:
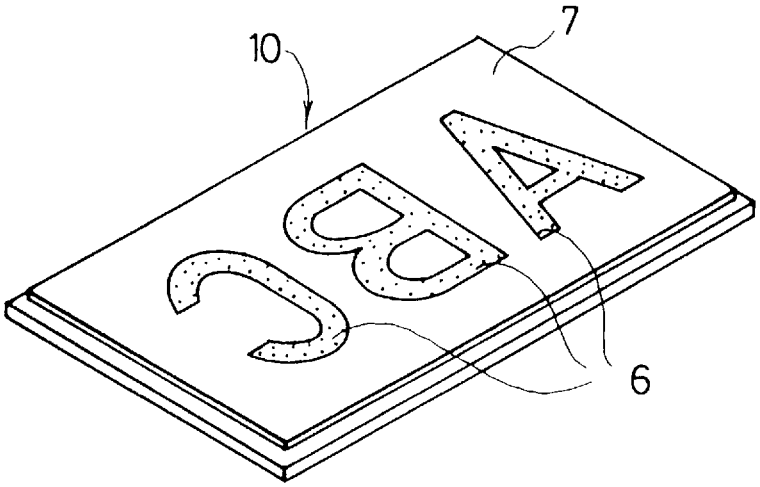
FIG. 2 is a perspective view of a marked seal plate having a mirror image of characters formed thereon.
Figure 3:
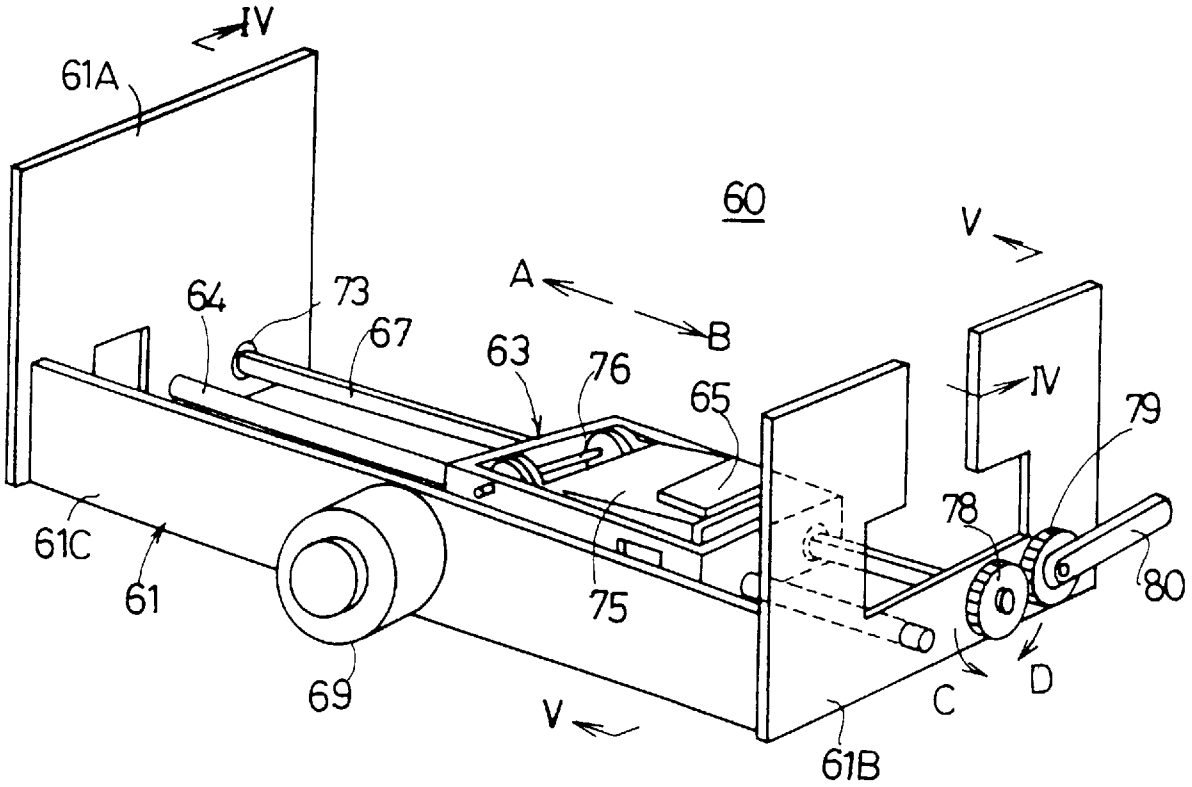
FIG. 3 is a perspective view of a marking device for forming the mirror image of characters on a seal plate.
Figure 4:
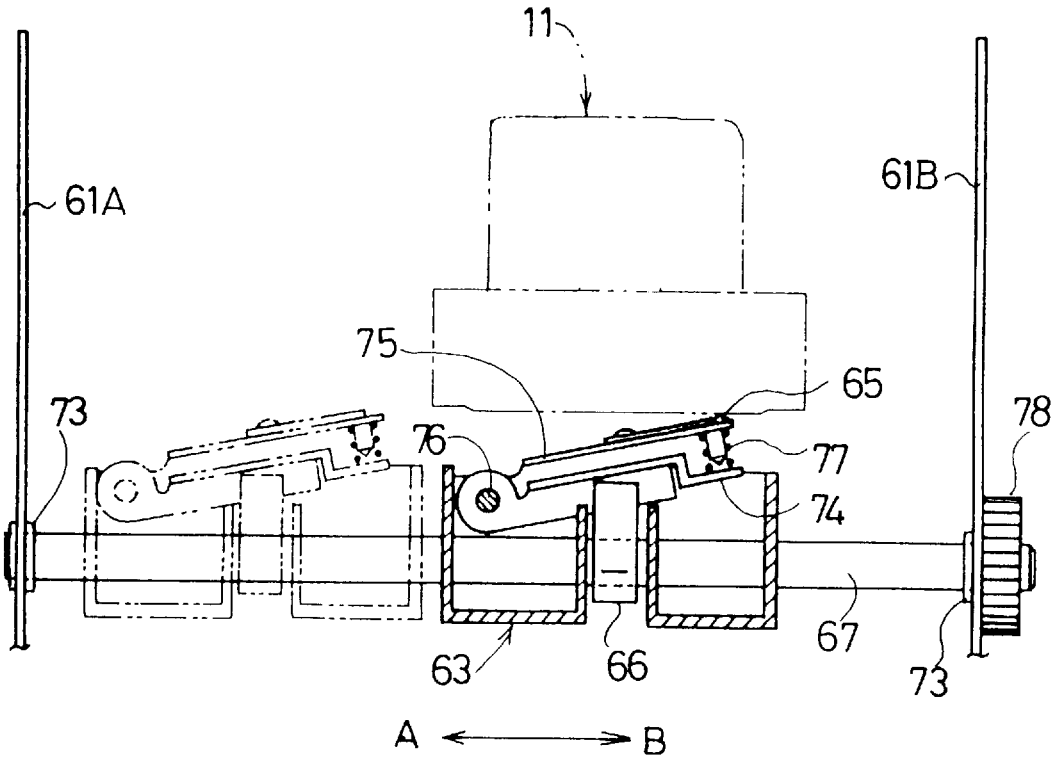
FIG. 4 is a sectional view of the device of FIG. 3 taken along a line IV—IV.
Figure 5:
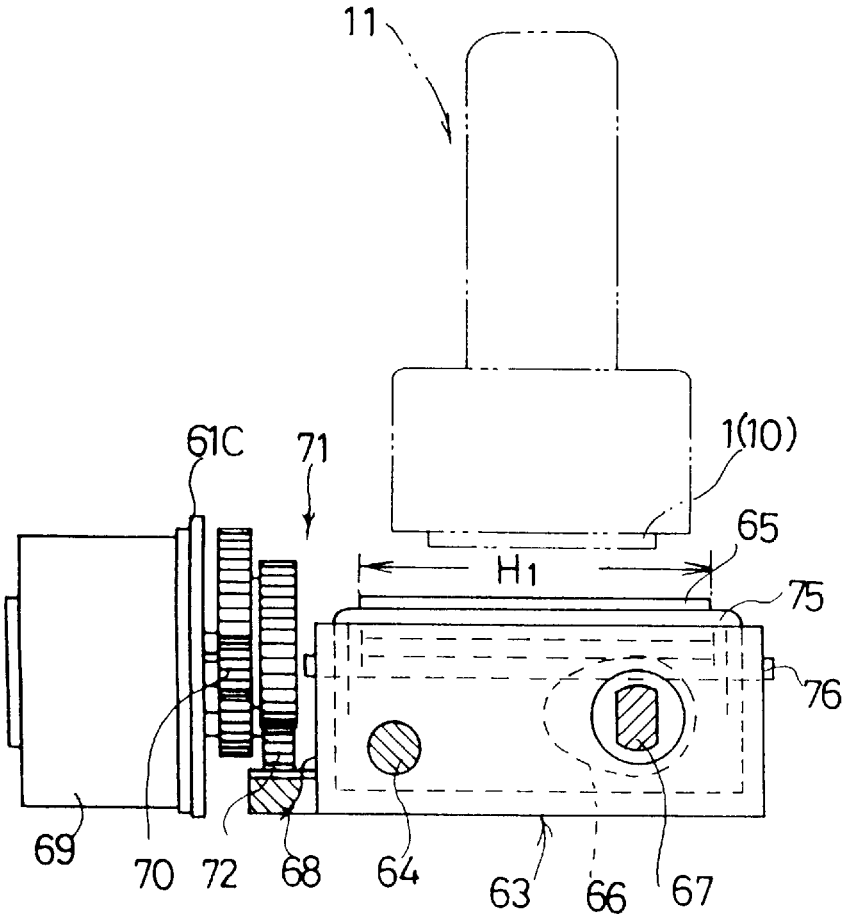
FIG. 5 is a sectional view of the device of FIG. 3 taken along a line V—V.

FIG. 2 is a perspective view of a seal plate (referred to as a marked seal plate 10) where character, or line drawing portions, 6 are formed at the seal face portion 2 in a mirror image shape of a character, such as a predetermined letter or figure, which are created by a marking device 60 as shown in FIG. 3 through FIG. 5. That is, between two end walls 61A and 61B of a frame 61 are mounted, a guide rod 64 extending in the left and right directions of FIG. 3 for guiding a carriage 63 and a head switch rod 67 extending in the left and right directions of FIG. 4 for guiding the carriage 63 and operating a cam 66 that elevates a thermal head 65 mounted on the carriage 63. The cam 66 is mounted unpivotably with respect to the head switch rod 67 and frictionally in the axial direction. The head switch rod 67 is rotatably supported by bearings 73 to the two end walls 61A and 61B.

The seal plate 1 is mounted onto a lower face of a stamp device 11, discussed later in detail, and positioned and fixed above a position where the carriage 63 passes, as illustrated in FIGS. 4 and 5. The carriage 63 is supported by the guide rod 64 and the head switch rod 67 so as to be movable in the left and right directions with respect to FIG. 4. A rack 68 is fixed to a front end of the carriage 63 integrally or via a suitable fixing means. Power is transmitted from a drive pinion 70 of a bi-directionally rotatable drive motor 69 fixed to a front face wall 61C of the frame 61, to a gear 72 in mesh with a reduction gear train 71 arranged on the back face of the front face wall 61C. The meshed gear 72 meshes with the rack 68 by which the carriage 63 can be moved in the left and the right directions (designated by arrows A and B in FIG. 3 and FIG. 4).

A cam contact plate 74 and a head heat radiating plate 75 are mounted on the carriage 63 and can pivot in the upward and downward directions via a support shaft 76. The thermal head 65 is fixed to an upper end side of the upper face of the head heat radiating plate 75, as shown in FIG. 4. Further, the head heat radiating plate 75 is always elastically urged by an urging spring 77 interposed between the upper face of the cam contact plate 74 and the back face of the head heat radiating plate 75.

The attitude of the cam 66 formed in an elliptical shape such that it can be brought into contact with a lower face of the cam contact plate 74, can be changed by pivoting the head switch rod 67 in directions represented by arrows C and D in FIG. 3. When the cam 66 lays horizontally as shown in FIG. 5, the head heat radiating plate 75 attached with the thermal head 65 is released downwardly. When the cam 66 is erected as shown in FIG. 4, the head heat radiating plate 75 is pivoted upwardly via the cam contact plate 74 and the urging spring 77 whereby the thermal head 65 is brought into press contact with the lower face of the seal plate 1 whose position has been fixed as described above. The head switch rod 67 is pivoted in directions C or D by means of a gear 78 attached to an end portion of the head switch rod 67, a gear 79, the axis of which is supported by the end wall 61B, and a lever 80 for pivoting the gear 79.

The thermal head 65 structured similar to a thermal head in a conventionally well-known thermal printer, in which, for example, 96 pieces of dot-like heat generating elements are arranged in one row in a direction orthogonal to the direction A of FIGS. 3 and 4. The row length of the dot-like heat generating elements is set to be longer than a lateral width dimension of the seal plate 1.

A control unit (not illustrated), for example, a microcomputer, in the marking device 60 is provided with a CPU (Central Processing Unit), ROMs (Read Only Memory), RAMs (Random Access Memory) and interfaces for operating the thermal head 65 and the drive motor 69. When the control unit drives the drive motor 69 while pressing the thermal head 65 toward the right end position of the seal face portion 2 by erecting the cam 66 as illustrated in FIG. 4 and drives all of the one row of the dot-like heat generating elements in the thermal head 65, the carriage 63 is moved in the direction A at a constant speed. In this way, a thin film through which ink cannot permeate is formed at portions of the seal face portion 2 where the surface of the foamed plastic is melted and solidified thereby forming the melted and solidified portion 7 through which ink cannot be permeate.

Next, when the dot-like heat generating elements in the thermal head 65 are controlled not to be heated in compliance with a print dot pattern based on previously inputted predetermined character data at predetermined portions of the seal face portion 2, a marked seal plate 10 can be manufactured in which the character portions 6 remain as portions, which have not been melted and solidified, through which ink can permeate while the other portions are the melted and solidified portion 7 through which ink cannot permeate. Such a marked seal plate 10 is illustrated in FIG. 2.

Next, an explanation of the structure of the stamp device 11 will be given. FIG. 6 through FIG. 9 illustrate a first embodiment of the stamp device 11 in which a handle portion 14 is formed integrally with or separately from a supporter 12. The supporter 12 has a square shape in plane view for supporting the back face of the seal plate 1. The seal plate 1 also has a substantially square flat plate shape in plane view.

Figure 6:
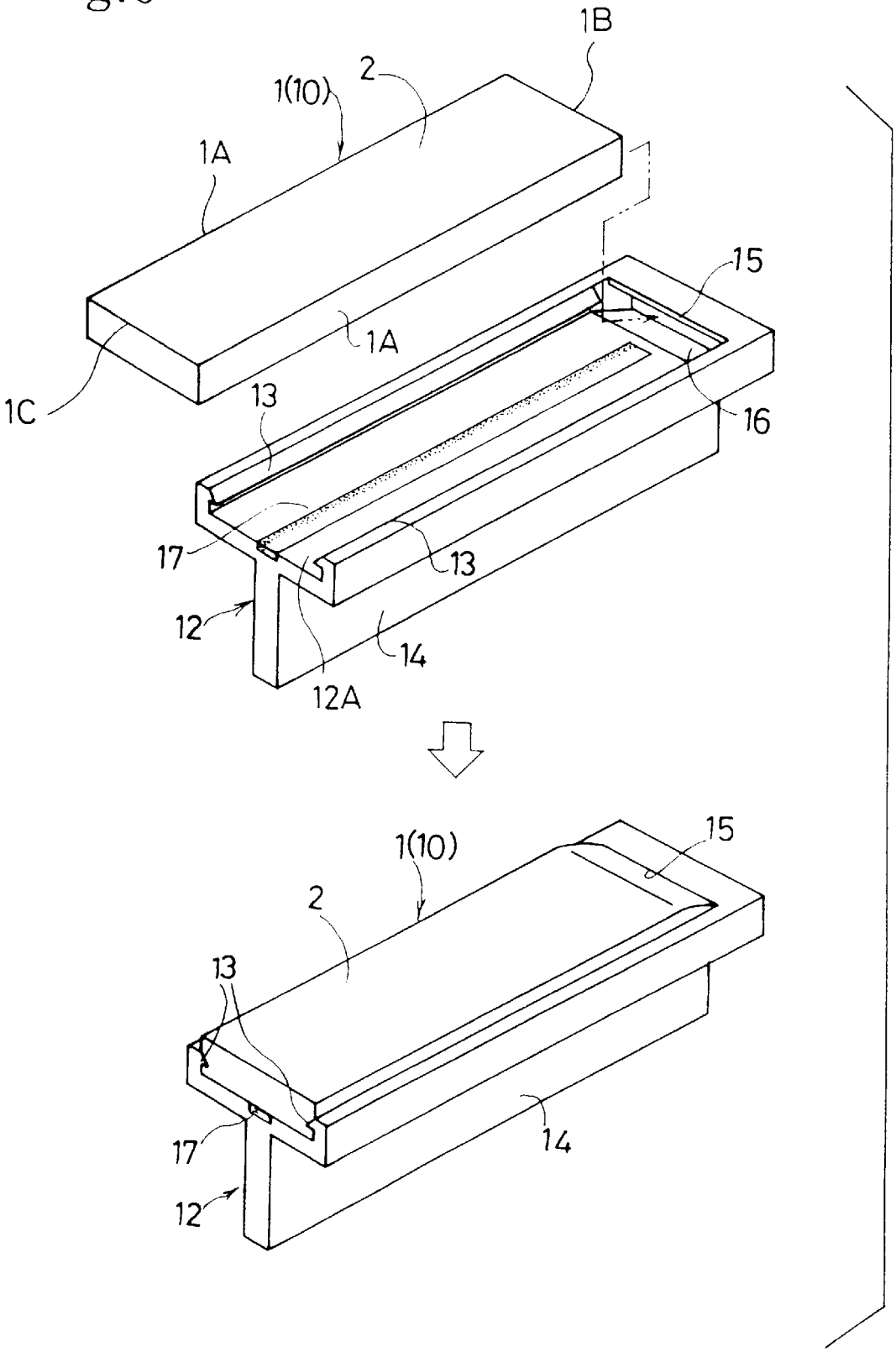
FIG. 6 is a perspective view of a first embodiment of the stamp device according to the invention and shows an operation of mounting a seal plate on a supporter of the stamp device.
Figure 8:
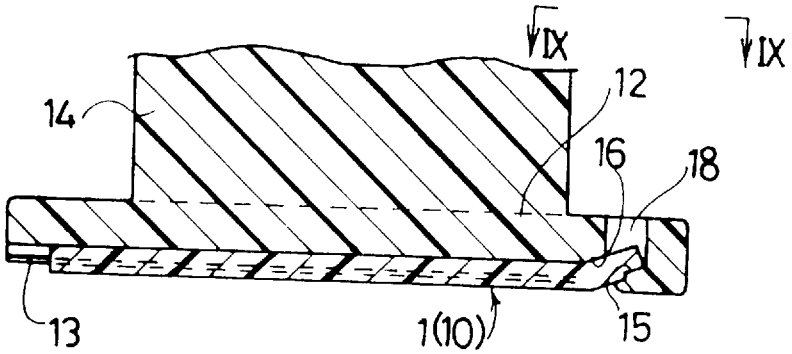
FIG. 8 is a side sectional view showing the seal plate mounted on the supporter of the stamp device of FIG. 6.
Figure 9:
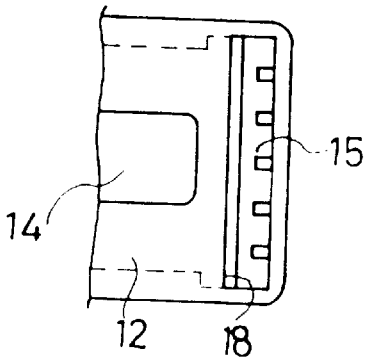
FIG. 9 is a view of the stamp device of FIG. 8 taken along a line IX—IX.

On one side surface of the supporter 12, a pair of engaging claws 13 extend in the longitudinal direction along a seal plate support face 12A of the supporter 12 and are provided to be in parallel with opposite edge faces 1A of the seal plate 1. The opposite edge faces 1A are elastically engaged by the engaging claws 13 and a recessed groove stopper portion 15 is provided for receiving therein and holding one end portion 1B of the seal plate 1, which end portion extends orthogonal to the edge faces 1A. As shown in FIG. 6, an inclined face 16 is formed at the recessed groove stopper portion 15 on one end of the seal plate supporting face 12A of the supporter 12. Further, a pressure sensitive weak adhesive layer 17 is provided on a portion of the seal plate supporting face 12A of the supporter 12 along the longitudinal direction thereof.

With such a structure, in order to mount the seal plate 1 onto the supporter 12, the one end portion 1B of the seal plate 1 is inserted into the recessed groove engaging portion 15 by sliding it along the inclined face and the seal plate is inserted between the pair of engaging claws 13 such that the back face of the seal plate 1 is pressed to the pressure sensitive weak adhesive layer 17. Thus, the opposite side edge faces 1A of the seal plate 1 or side edge corner portions of the seal face portion 2 of the seal plate 1 can be elastically engaged by the pair of engaging claws 13.

Accordingly, the back face of the seal plate 1 is fixed onto a portion of the seal plate supporting face 12A of the supporter 12 by the pressure sensitive weak adhesive layer 17 while the opposite edge faces 1A of the seal plate 1 are engaged by the pair of engaging claws 13 and further, the one end portion 1B of the seal plate is held by the recessed groove stopper portion 15. Accordingly, the seal plate 1 is removably mounted to the supporter 12 with certainty and is secured until removed.

Figure 7:
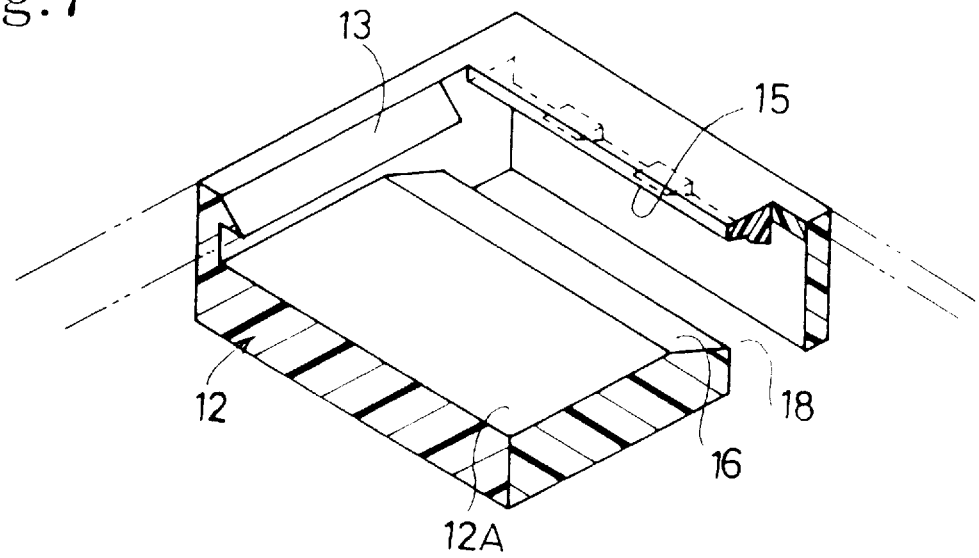
FIG. 7 is a perspective view of the supporter of FIG. 6.
Figure 7A:
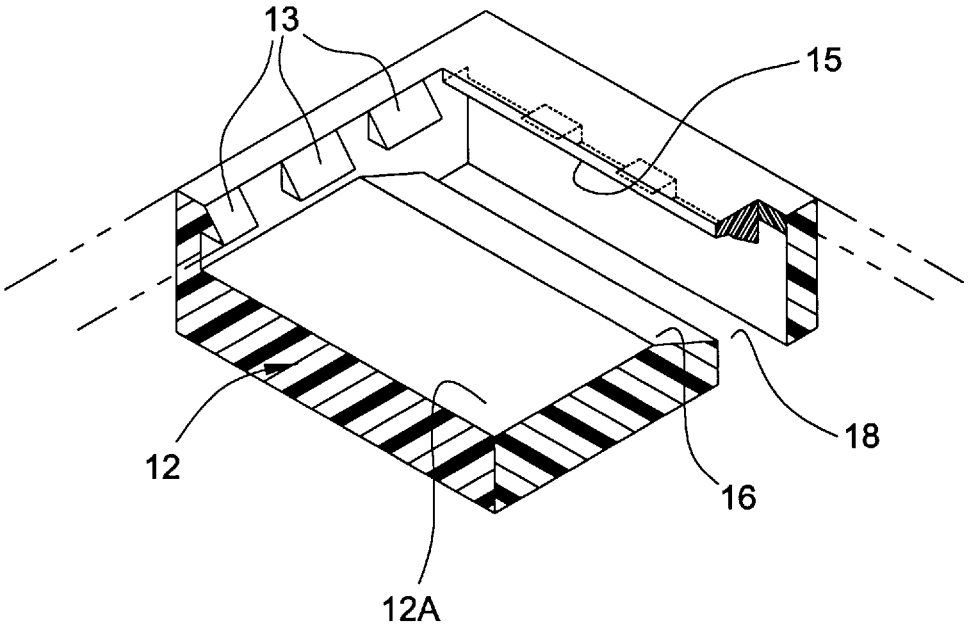
FIG. 7A is a perspective view of a supporter having engaging claws that are formed intermittently in the longitudinal direction of the seal plate.
Figure 10:
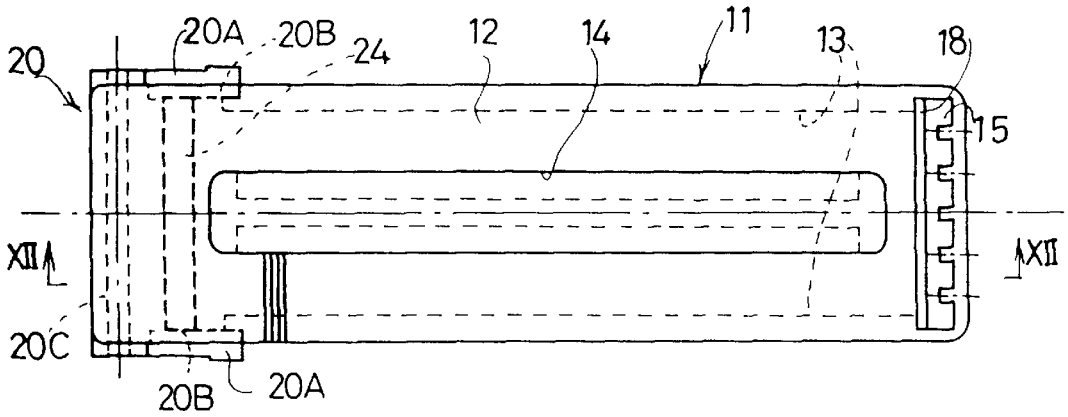
FIG. 10 is a plane view of a second embodiment of a stamp device according to the invention.
Figure 11:
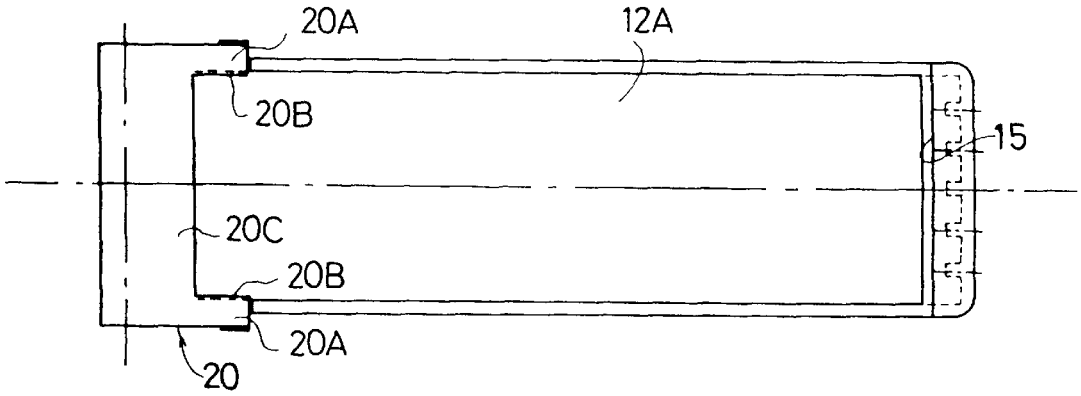
FIG. 11 is a bottom view of the stamp device of FIG. 10.

The pair of engaging claws 13 may be formed continuously in the longitudinal direction of the seal plate 1 (refer to FIGS. 6A and 6B), or intermittently whereby portions of the seal plate are not engaged (see, for example, FIG. 7A). Additionally, a through hole 18 penetrating the surface and the back face of a thick portion of the supporter 12 may be perforated at the recessed groove stopper portion 15.

FIG. 10 through FIG. 17 illustrate a second embodiment of the invention showing flat plate-shaped seal plate 1 having a structure similar to the above-described one and supporter 12 for supporting the back face of the seal plate 1. The supporter 12 is provided with the pair of engaging claws 13 extending in the longitudinal direction thereof for pinching the opposite side edge faces 1A of the seal plate 1 and the recessed groove stopper portion 15 for holding the one end portion 1B of the seal plate 1 by receiving the one end portion 1B therein. The supporter 12 is further provided with a pivoting pinching device 20 at an end portion 1C opposite to the end portion 1B having the recessed groove stopper portion 15 for pinching the other end portion of the seal plate 1 between the pivoting pinching device 20 and the seal plate supporting face 12A.

The pivoting pinching device 20 is formed in substantially a "C" shape in plane view and is provided with a connecting piece 20C for connecting handles 20A on two sides and hold pieces 20B at both end portions lB, 1C of the connecting piece 20C. The pivoting pinching device 20 is pivotably mounted to the other end portion 1C of the supporter 12 at portions of the two handles 20A via support shafts 21. When the two handles 20A are fixed to the supporter 12 by engaging means comprising stopper holes 22 provided in the two handles 20A and projected portions 23 provided on two side faces of the supporter 12, the corner portions at the other end portion 1C of the seal plate 1 are fixedly pinched in a notched groove 24 of the seal plate supporting face 12A by the back faces of the hold pieces 20B.

Figure 12:
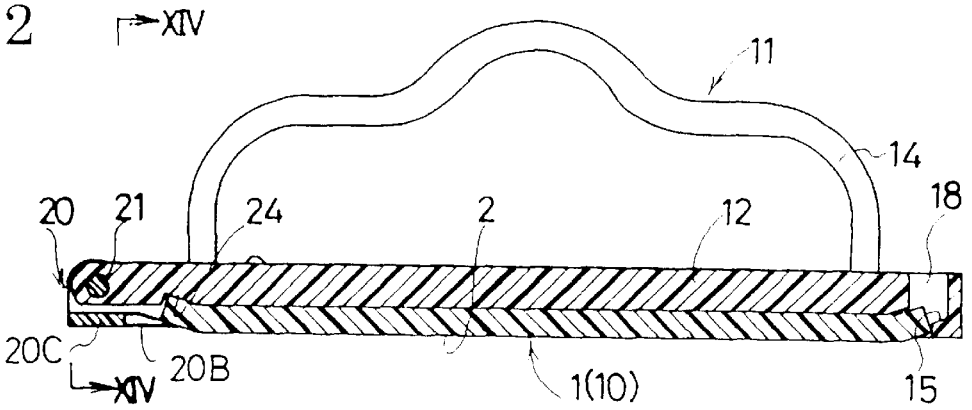
FIG. 12 is a view of the stamp device of FIG. 10 taken along a line XII—XII.
Figure 13:
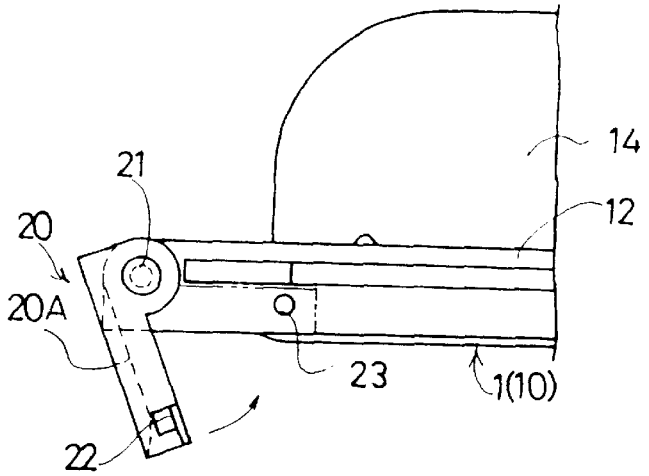
FIG. 13 is a side view of a handle portion of a pivoting pinching device of the stamp device of FIG. 10.
Figure 14:
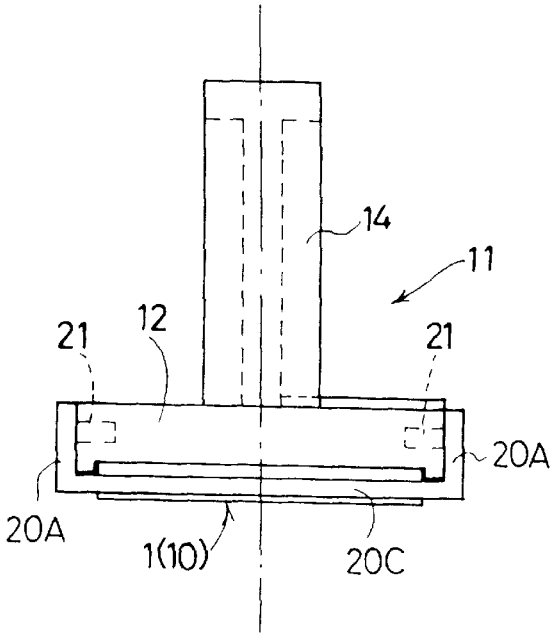
FIG. 14 is a view of the stamp device of FIG. 12 taken along a line XIV—XIV.
Figure 15:
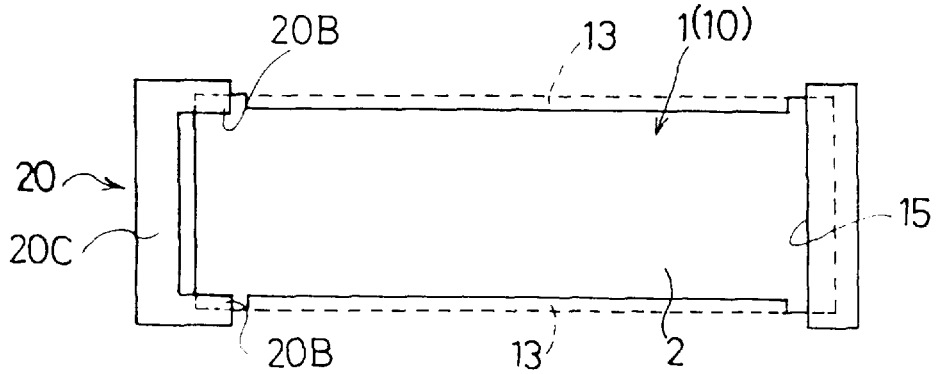
FIG. 15 is an explanatory view showing a pinching portion of the stamp device of FIG. 10.

With this structure, similar to the first embodiment, the opposite end faces 1A of the seal plate 1 are engaged with the pair of engaging claws 13 and further, the one end portion 1B of the seal plate received by the recessed groove engaging portion 15 and held therein, whereas the other end portion 1C of the seal plate 1 is pinched by the hold pieces 20B of the pivoting pinching device 20 such that it is pushed into the notched groove 24 (refer to FIG. 12). According to this embodiment, as illustrated in FIG. 15, the three surrounding sides of the seal plate 1 can be held by the supporter 12 and therefore, the seal plate 1 is removably mounted to the supporter 12 with certainty and is secured until removed.

Figure 16:
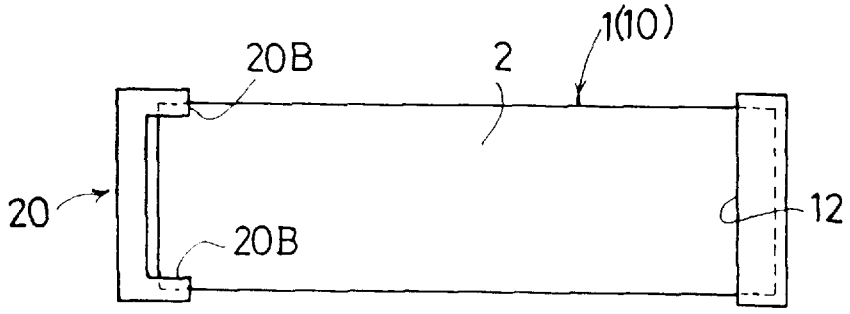
FIG. 16 is an explanatory view showing the stamping device of FIG. 10 without the engaging claws 13.
Figure 17:
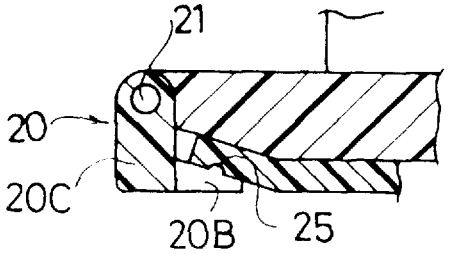
FIG. 17 is a side sectional view of another embodiment of a hold piece.

As a modified example of the second embodiment, when the pair of engaging claws 13 are omitted, as illustrated in FIG. 16, the seal plate 1 can be pressed to the seal plate supporting face 12A of the supporter 12 by the recessed groove stopper portion 15 and by pushing the corner portion of the seal plate 1 opposed to the recessed groove stopper portion 15 by the hold pieces 20B of the pivoting pinching device 20. Further, as illustrated in FIG. 17, the force for pressing and pinching the other end portion 1C of the seal plate 1 to the seal plate supporting face 12A of the supporter 12 can be increased by providing stopper projections 25 on the respective hold pieces 20B.

Figure 18:
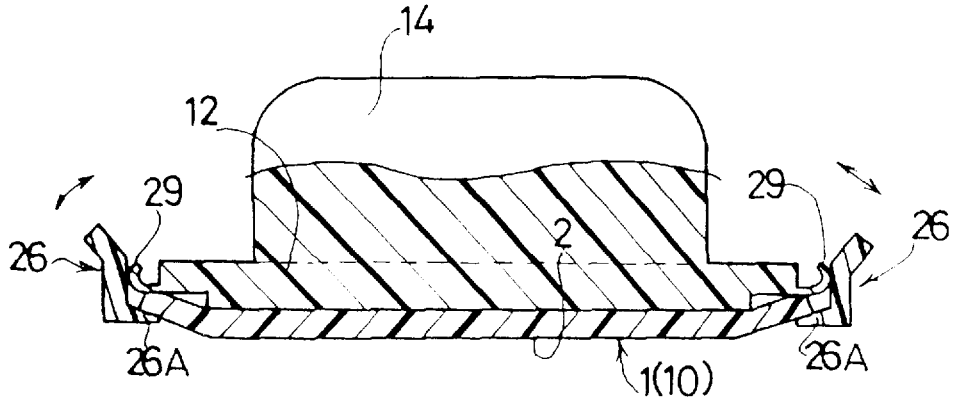
FIG. 18 is a partially broken side view of a third embodiment of a stamp device according to the invention.
Figure 19:
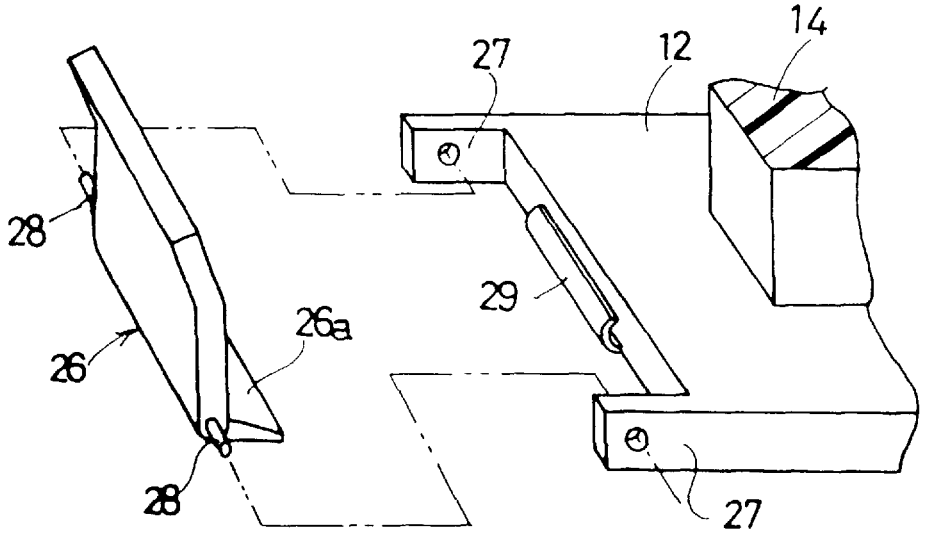
FIG. 19 is a perspective view of a pinching device of the stamp device of FIG. 18.

According to a third embodiment illustrated in FIG. 18 and FIG. 19, pinching bodies 26 are pivotally provided at both end portions of the supporter 12 and the end portions 1B, 1C of the seal plate 1 are pinched by the two pivoting pinching bodies 26 by being pushed onto the seal plate supporting face 12A of the supporter 12, as illustrated in FIG. 19. Both pinching bodies 26 have an L-shaped section and are pivotably connected to end brackets 27 of the supporter 12 via pins 28. A lower end pushing piece 26A of the pinching body 26 pinches the end portion of the seal plate 1 by pushing it toward the seal plate supporting face 12A of the supporter 12 and a spring 29 in a bent shape is provided integrally to a side face of the supporter 12 between the end brackets 27.

In the above-described respective embodiments, by lowering both end portions of the seal plate supporting face 12A of the supporter 12, the recessed groove stopper portion 15 and the hold pieces 20B, or 26A of the pivoting pinching device 20 or pinching bodies 26 do not project to the outside of the seal face portion 2 of the seal plate 1 so that the stamping operation and the marking operation are not hindered.

In the above-described respective embodiments, when the above-described marking operation is carried out by mounting the seal plate 1 to the stamp device 11 having the above-described structure and by fixing the stamp device to a predetermined portion of the marking device 60, a seal having the melted and solidified portion 7 through which ink cannot permeate and the portion, which has not been melted and solidified, through which ink can permeate can simply be formed at the seal portion 2 of the seal plate 1. In this case, a projected region is formed such that the portion (character portion 6), which has not been melted and solidified, through which ink can permeate is higher than the melted and solidified portion 7 through which ink cannot permeate. Accordingly, a seal image is formed clearly.

Further, a width H1 of the head heat radiating plate 75, which is equal in length to the row of dot-like heat generating elements in the thermal head 65, is set a little wider than the width of the seal face portion 2 of the seal plate 1. Thus, the surface of the seal face portion 2 other than the character portions 6 can be rendered the melted and solidified portion 7 through which ink cannot permeate and ink cannot leak out from unnecessary portions.

Further, in the above-described respective embodiments, when the seal plate 1 is mounted to the supporter 12, in the marking operation the seal plate 1 does not shift from the supporter 12 even if the seal face portion 2 of the seal plate 1 is rubbed by the thermal head 65. Thus, its position can be maintained with certainty and the marking operation can firmly be carried out.

Further, the finished, marked seal plate 10 may be removed from the supporter 12 by methods particular to the above-described respective embodiments. When a new seal plate 1 is mounted thereafter and the marking operation is repeated, the marked seal plate 10 can be manufactured easily and swiftly.

Further, the finished marked seal plate 10 is pushed onto an ink impregnating pad (not illustrated) while being mounted to each of the stamp devices 11 or ink is absorbed to the inside from the character portions 6 which are the unmelted portions through which ink cannot permeate and thereafter, sealing is conducted on record medium such as paper.

While the invention has been described in conjunction with specific embodiments thereof, it is evident that many alternatives, modifications and variations may be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A stamp device, comprising:

a flat plate-shaped seal plate formed of a melted and solidified portion through which ink cannot permeate and a portion, which has not been melted and solidified, through which ink can permeate at a seal face portion of a foamed plastic substrate having continuous foams, the seal plate having a plurality of edges; and a supporter having a support portion that supports a back face of the seal plate, wherein the supporter is provided with an engaging device for engaging and deforming at least two edges of the plurality of edges of the seal plate, at least a portion of the engaging device being integrally formed with the support portion and extending therefrom.

2. The stamp device of claim 1, wherein the engaging device includes a recessed groove stopper portion for receiving thereunder and holding one end portion of the seal plate and a pivoting pinching device that pinches another end portion of the seal plate between the pivoting pinching device and the supporter supporting the seal plate.

3. The stamp device of claim 1, wherein the engaging device includes a pair of pivoting pinching device that each pinch a respective one of a pair of end portions of the seal plate between the respective pinching device and the supporter for supporting the seal plate.

4. The stamp device according to claim 1, further comprising an adhesive layer provided on the supporter that supports the seal plate and extending along a longitudinal axis of the supporter.

5. The stamp device of claim 1, wherein the engaging device includes a pair of engaging claws for pinching edge faces of longitudinally extending opposed edges of the seal plate and a recessed groove stopper portion for receiving thereunder and holding one end portion of the seal plate.

6. The stamp device according to claim 5, wherein the supporter is further provided with a pivoting pinching device that pinches another end portion of the seal plate between the pivoting pinching device and the supporter supporting the seal plate.

7. The stamp device according to claim 1, wherein the plurality of edges of the seal plate includes two end edges and the engaging device comprises a pair of pivoting pinching devices, each of the respective pivoting pinching devices pinching an end portion of one of the two end edges of the seal plate between the respective pivoting pinching device and the supporter that supports the seal plate.

8. The stamp device according to claim 7, wherein each of the pair of pivoting pinching devices are mounted to a bracket on the respective one of the two end edges of the supporter via pins.

9. The stamp device according to claim 7, wherein each of the pair of pivoting pinching devices is "L" shaped in side view and includes a lower end pushing piece for pinching the respective end portion of the seal plate between the respective pivoting pinching device and a spring integral with the supporter.

10. The stamp device according to claim 1, wherein the plurality of edges of the seal plate includes two end edges and the engaging device comprises a recessed groove stopper portion for receiving thereunder and holding an end portion of one of the two end edges of the seal plate and a pivoting pinching device for pinching an end portion of the other of the two end edges of the seal plate between the pivoting pinching device and the supporter that supports the seal plate.

11. The stamp device according to claim 10, wherein the pivoting pinching device is "C" shaped in plane view and includes two connecting handles which are pivotably mounted on the supporter and a connecting piece that connects the two handles.

12. The stamp device according to claim 10, wherein a portion of the face of the supporter which is located adjacent the recessed groove stopper portion is inclined away from the recessed groove stopper portion.

13. The stamp device according to claim 1, wherein the plurality of edges of the seal plate includes two opposed longitudinally extending edges and two end edges, and the engaging device comprises a pair of engaging claws for pinching edge faces of the opposed longitudinally extending edges and a recessed groove stopper portion for receiving thereunder and holding an end portion of one of the two end edges.

14. The stamp device according to claim 13, wherein a portion of the supporter which is located adjacent the recessed groove stopper portion is inclined away from the recessed groove stopper portion.

15. The stamp device according to claim 13, wherein a through-hole is provided in the supporter adjacent the recessed groove stopper portion.

16. The stamp device according to claim 13, wherein each of the pair of engaging claws comprises a claw member which extends continuously along the opposed longitudinally extending edge faces of the seal plate.

17. The stamp device according to claim 13, wherein each of the pair of engaging claws comprises a plurality of claw members intermittently disposed along the opposed longitudinally extending edge faces of the seal plate.

18. The stamp device according to claim 13, wherein the engaging device further comprises a pivoting pinching device for pinching an end portion of the other of the two end edges of the seal plate between the pivoting pinching device and the supporter that supports the seal plate.

19. The stamp device according to claim 18, wherein the pivoting pinching device is "C" shaped in plane view and includes two connecting handles which are pivotably mounted on the supporter and a connecting piece that connects the two handles.

* * * * *